US007060005B2

(12) United States Patent
Carlsen et al.

(10) Patent No.: US 7,060,005 B2
(45) Date of Patent: Jun. 13, 2006

(54) EXERCISE DEVICE

(75) Inventors: Steven Carlsen, Newbury Park, CA (US); Anita Liu-Miller, Ventura, CA (US)

(73) Assignee: Diamondback Fitness, Inc., Kent, WA (US)

( * ) Notice: Subject to any disclaimer, the term of this patent is extended or adjusted under 35 U.S.C. 154(b) by 187 days.

(21) Appl. No.: 10/710,911

(22) Filed: Aug. 12, 2004

(65) Prior Publication Data

US 2005/0148438 A1 Jul. 7, 2005

Related U.S. Application Data

(60) Provisional application No. 60/534,335, filed on Jan. 5, 2004.

(51) Int. Cl.
*A63B 69/16* (2006.01)
*A63B 22/04* (2006.01)

(52) U.S. Cl. ..... 482/52; 482/57

(58) Field of Classification Search ..... 482/51–53, 482/57, 70, 79–80
See application file for complete search history.

(56) References Cited

U.S. PATENT DOCUMENTS 5,383,829 A 1/1995 Miller ..... 482/57
5,685,804 A 11/1997 Whan-Tong ..... 482/51
5,792,026 A 8/1998 Maresh ..... 482/51
5,895,339 A 4/1999 Maresh ..... 482/51
5,957,814 A 9/1999 Eschenbach ..... 482/51
5,993,359 A * 11/1999 Eschenbach ..... 482/57
5,997,445 A 12/1999 Stearns ..... 482/70
6,146,313 A 11/2000 Whan-Tong ..... 482/51
6,168,552 B1 1/2001 Eschenbach ..... 482/52
6,248,044 B1 6/2001 Stearns ..... 482/52
6,440,042 B1 8/2002 Eschenbach ..... 482/52
6,482,130 B1 11/2002 Pasero ..... 482/51
6,689,019 B1 * 2/2004 Ohrt et al. ..... 482/52
6,949,054 B1 * 9/2005 Stearns et al. ..... 482/52

* cited by examiner

*Primary Examiner*—Stephen R. Crow
(74) *Attorney, Agent, or Firm*—Ralph D. Chabot

(57) ABSTRACT

An exercise apparatus having a pair of support pedals that, when a user steps upon both pedals, can be moved by the user in a closed path that is designed to be complimentary in motion to that of the user's natural stride. The pedals are operably connected by a linkage that facilitates this natural motion. Moreover, this linkage can be adjusted thereby altering the shape of the closed path traveled by the pedals. The closed path can thus be altered to conform to the optimal biomechanics of each individual user or, it can be altered to form a closed path designed for more of a striding type of exercise or for more of a climbing exercise, thereby allowing different muscle groups to be exercised on the same machine.

26 Claims, 5 Drawing Sheets

EXERCISE DEVICE

CROSS-REFERENCE TO RELATED APPLICATIONS

This application claims the benefit of U.S. Provisional Application bearing Ser. No. 60/534,335 filed Jan. 5, 2004.

FIELD OF THE INVENTION

The present invention relates to exercise apparatus and methods to enhance exercise. More particularly, the present invention relates to exercise devices with closed curvilinear pedal paths which may be adjustable and may include coordinated arm motion.

BACKGROUND OF THE INVENTION

The benefits of regular exercise are well known and recently there has been considerable evolution in exercise products which are resistive in nature and designed to improve one's cardiopulmonary endurance. Initially, exercise bikes were developed which gave the user a plain circular pedal path that mimicked road cycling. Cross country ski machines have provided linear reciprocating paths. Steppers have mimicked the motion of climbing stairs with oscillatory pedals. Lately, there has been a trend toward more complicated motions that move a pedal in a generally elliptical curved path and attempt to mimic walking or jogging.

These elliptical machines have themselves evolved over time and come in many configurations. As the elliptical machines have evolved, several strategies have been developed to improve the biomechanics of the path of the pedal.

U.S. Pat. No. 5,383,829 to Miller; U.S. Pat. No. 5,685,804 to Whan-Tong et al.; U.S. Pat. No. 6,482,130 to Pasero et al.; and U.S. Pat. No. 6,146,313 to Whan-Tong et al. describe various versions of an exercise machine that produce elliptical motion at the foot placement or pedals by using a large crank attached to one end of a foot supporting member and either a rolling element or a swinging rocker at the other end to guide the foot supporting member along a reciprocating path. The pedal path may be adjusted in various ways resulting in the angle of the ellipse major axis being more steeply inclined.

The problem with these designs is twofold. Due to the circular path of the crank, the ratio of ellipse major axis to minor axis is smaller when compared to the normal walking stride of an individual and, as a consequence, not optimal for biomechanics. This is to say that the ellipse height is too deep in relation to the length. The second problem is in the nature of the ellipse. Due to the simple crank-rocker or crank-slider type linkage, there is a great deal of angular change in the vicinity of direction changes. This tends to feel abrupt for many people and results in the foot being angled upward as the foot travels back in the stride.

U.S. Pat. Nos. 5,957,814, 6,168,552 and 6,440,042 to Eschenbach describe a unit consisting of a crank, various linkage elements, a pair of pedal members and a guide upon which rolls the ends of each pedal member. The guide is adjustable in order to change the pedal paths.

U.S. Pat. Nos. 5,997,445 and 6,248,044 to Steams and Maresh describe devices that use a rocker linkage to provide elliptical motion at the end of a pedal link which is guided in the middle with the user standing on a pair of pedals which are cantilevered at the rear. The guide means may take the form of a rolling member or a linkage member. The guide means for the rolling member may be adjusted to change the pedal path. It should be noted that this configuration produces a motion at the pedal link joint (designated as P1 in FIG. 2 and 3 of U.S. Pat. No. 5,997,445) which is purely elliptical in shape as shown and described in the art.

U.S. Pat No. 5,895,339 to Maresh describes another exercise device that utilizes a crank and rocker arrangement to generate an elliptical path.

U.S Pat. No. 5,792,026 to Maresh and Steams describes a device that utilizes a crank and drawbar mechanism to elongate the pedal path.

The defining point in the majority of the prior art is in developing a mechanism which converts the circular motion of a crank into a substantially elliptical path occurring at the pivot point where the link member or pedal arm is attached. This is done to maximize the length of the stride while at the same time keeping the height within reasonable limits for proper biomechanics. The shape of the travel path of this pivot point is a key element in providing a normal stride feel to the user.

Indeed, due to an individual's biomechanics and preferences, there becomes a need for a means to alter the shape or size of the pivot point travel path in order to accommodate the preferences of a variety of users.

SUMMARY OF THE INVENTION

The present invention discloses a novel linkage configuration for providing a cyclic motion more representative of a normal stride cycle than achieved with elliptical exercise machines utilizing circular or elliptical shaped travel paths occurring at the pedal arm pivot points.

The pedal arm pivot point is defined as the pivotal connection between a pedal arm and the remaining portion of its linkage configuration. The cyclic path traveled by the pedal arm pivot point is of a substantially tear-drop shape and is represented as P1 in FIG. 4.

The pedal travel path is herein defined as the cyclic path traveled by the pedal area or surface upon which the heel portion of an individual's foot can be placed. The pedal travel path is not elliptical. Rather, it is a cyclic path wherein the amount of the stride cycle utilized when lowering the heel as the foot strides to its maximum distance in front of the body is substantially less than the amount of the stride cycle utilized when raising the heel as the foot strides to its maximum distance behind the body.

The pedal travel path can take various forms and is a result of the substantially teardrop shaped travel path of the pedal arm pivot point P1; examples of which are H1 in FIG. 4; H2 in FIG. 5; Lb in FIG. 6; and, Lc in FIG. 7. The various forms are dependent upon the adjustments made to the linkage configuration for changing stride length and height.

The exercise device comprises a frame intended to rest on a floor or other supporting surface having a crank axis essentially perpendicular to the longitudinal axis, a pair of elongated pedal arms, at least one output pulley rotatably connected to the frame and at least one resistance device operatively connected to the output pulley, and a pair of linkage means each operatively connected to the output pulley and to a respective pedal arm. In a preferred embodiment, a pair of elongated handles is provided for upper-body exercise.

Each linkage means includes a pivotal connection to the pedal arm defining the pedal arm pivot point described earlier as well as a traveling means for limiting a portion of each pedal arm to a back-and-forth or reciprocating motion.

The traveling means will typically include: a) an axle-wheel combination for travel, preferably engaging a guide; b) a sliding sleeve for operative travel along a guide; or, c) a linkage combination. As the exercise device is being used, each of the pedal arm pivot points travel in a sub-stantially tear-drop cyclic path in response to displacement of the pedals arms along the longitudinal axis.

As is understood by those having skill in the art, each linkage means is 180 degrees out of phase relative to the other in order for the exercise device to function properly.

Each linkage means can be comprised of any various combinations of links or other connectors to constrain movement to a particular desired path. Suitable constraints can include any suitable alternative, be it rolling, sliding, a pivoting rocker, or so on, and the principles of the present invention continue to apply.

As with elliptical devices well known in the art, the output pulley can be operatively connected to a resistance device by a belt or other suitable means. These other suitable means include a chain or use of direct-drive.

In one preferred embodiment, a pair of elongated pedal arms is provided; each having a pedal or surface area suitable for an individual to step upon. These pedal arms in turn can transfer the forces generated by that individual to respective intermediate links. A portion of each pedal arm is limited to movement along one direction in a reciprocating movement by a traveling means that can include a rocker link, or at least one rotatable wheel connected to the pedal arm by an axle, or a sliding sleeve, where the sleeve or wheel is designed to travel along a guide. At another point, each pedal arm is connected to a respective intermediate link as described earlier and which defines the pedal arm pivot point.

Each intermediate link is operatively attached to the frame using a link or other means and the attachment point defines a second pivot point. This second pivot point is limited to movement along a path that is determined by its connection to the frame. Each intermediate link includes a third pivot point located at its medial portion that connects to a respective output link.

Each output link is rotatably connected to a respective crank. Each output link is also operatively attached to the frame using a link or other means that defines a first pivot point which limits movement to a reciprocating fashion.

In a preferred embodiment, the exercise device incorporates a pair of elongated members each having a handle or hand gripping surface located at a distal end. Each elongated member is pivotally connected to the frame and operatively connected to a respective linkage for providing upper body exercise.

Further features and benefits of the present invention will become apparent from the detailed description that follows.

One objective of the present invention is a mechanism that produces improved biomechanics relative to machines currently available. Further, to tailor the biomechanics of the machine to a particular individual, the invention can be adjusted and, the specific mechanism disclosed in the present invention is ideal to satisfy the aim of adjustability. Another objective of the present invention is to satisfy the need for varied exercise from a single machine. This is accomplished by changing the pedal path to work different muscle groups of the legs.

The exercise machine can be designed for folding into a compact profile that can be stored or moved more efficiently.

DETAILED DESCRIPTION OF THE PREFERRED EMBODIMENT

Figure 1:
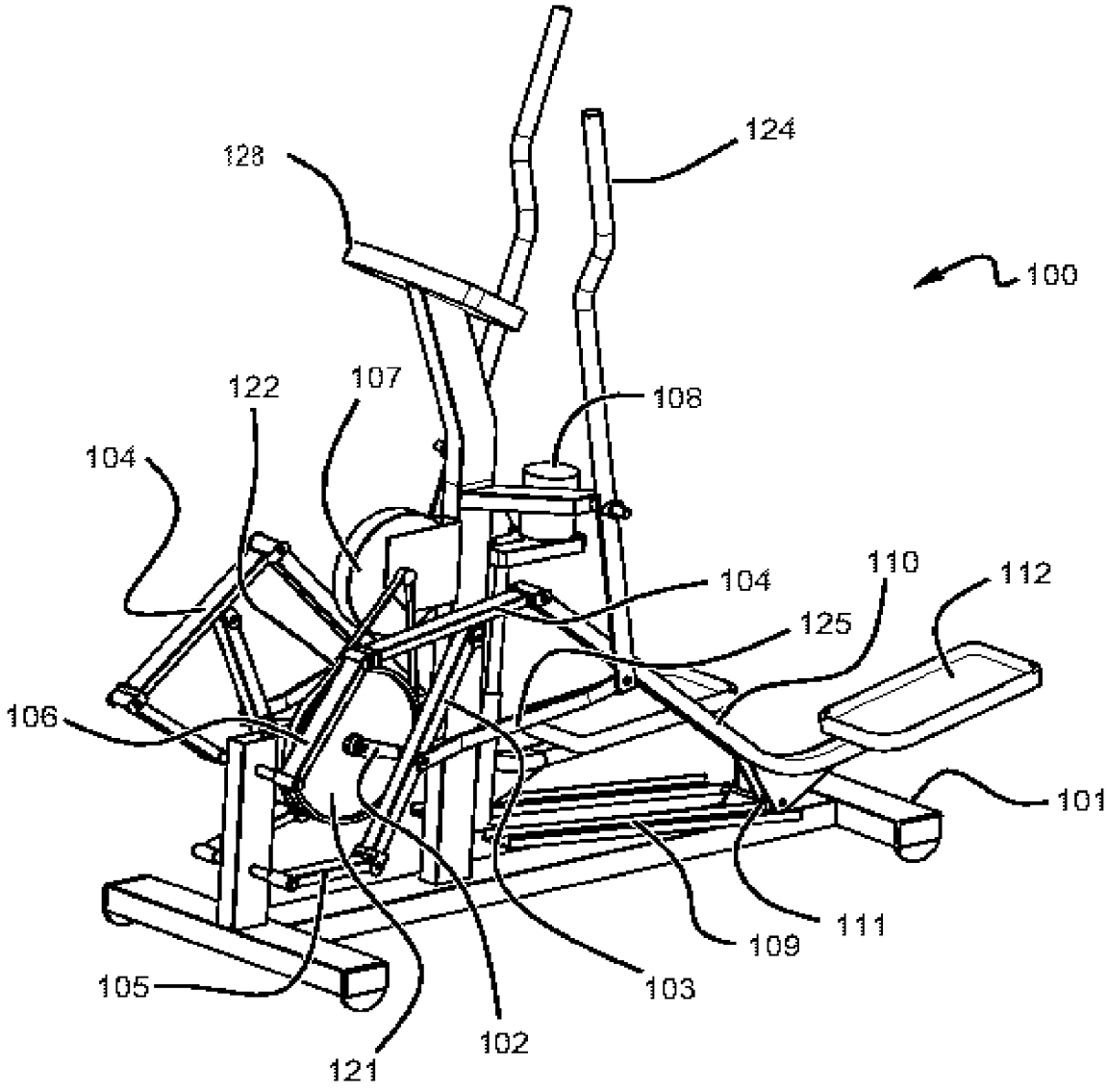
FIG. 1 is a perspective view of a first preferred embodiment exercise device constructed in accordance with the present invention.
Figure 2:
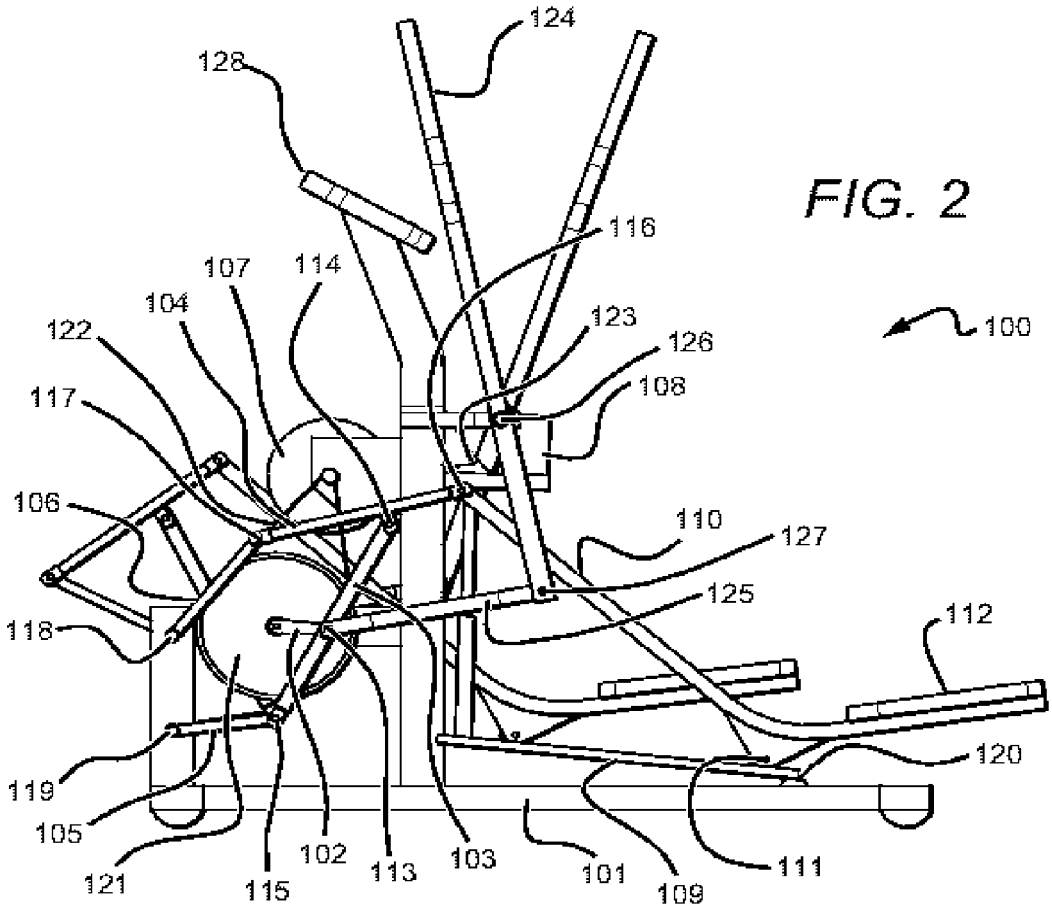
FIG. 2 is a side view of the exercise device shown in FIG. 1.

A preferred embodiment exercise machine constructed according to the principles of the current invention is designated as 100 in FIGS. 1 and 2.

Exercise machine 100 comprises a frame 101 that is intended to rest on a floor or other supporting surface. Frame 101 includes a crank axis which is essentially perpendicular to the longitudinal axis of frame 101 and a pair of cranks 102, both rotatably connected to frame 101 at the crank axis.

Exercise machine 100 includes a generally symmetrical layout of left and right hand linkage elements mounted on frame 101. Generally speaking, the motion of the linkage elements, link and convert a relatively complex closed path traveled by left and right pedals 112 to a simple circular motion of the crank arms 102.

The linkage assembly is comprised of left and right pedal arms 110, left and right intermediate links 104, left and right output links 103, rocker links 105 and 106.

Viewing FIG. 2, left and right output links 103 each have a pair of distal ends and a medial portion. Each output link 103 is rotatably connected at its medial portion to respective crank arms 102 to define a first connection point 113, wherein the left and right crank arms are essentially 180 degrees apart from one another and are connected via a common shaft to an output pulley 121. This output pulley is linked via a belt 122 or other suitable means to a resistance device 107.

The left and right output links 103 are operatively connected to frame 101 near one distal end rotatably connected to a respective rocker link 105, the rotatable connection defining a respective first pivot point 115. This linkage arrangement limits movement of each first pivot point 115 to a first reciprocating path relative to frame 101. The opposite ends of rocker links 105 are rotatably connected to the front portion of the frame 101 at 119.

One end of each intermediate link 104 is rotatably connected to a respective rocker 106 at pivot point 117 thereby defining a second pivot point. This linkage arrangement limits movement of each second pivot point to a second reciprocating path relative to frame 101. The opposite ends of the left and right output links 103 are rotatably connected to the medial portion of left and right intermediate link 104 at respective pivot points 114 thereby defining a third pivot point.

The opposite ends of rockers 106 are rotatably connected to the front portion of frame 101 at 118. The opposite ends of intermediate links 104 are connected to respective pedal arms 110 at pedal arm pivot point 116.

The left and right pedal arms 110 are elongated and each include a pedal 112 or surface area for an individual to stand upon with one foot. At least one wheel 111 is connected by an axle to each pedal arm 110, arranged to roll on guide 109. Guide 109 is rotatably connected to frame 101 at pivot point 120 thereby defining a fourth pivot point. The opposite end of guide 109 is supported by the movable end of an actuator 108. The opposite end of actuator 108 is rotatably attached to frame 101 at pivot point 123.

A control console 128 is provided for controlling the resistance exerted by resistance device 107 and also to control the position of guide 109 through monitoring and controlling the position of the actuator 108.

A pair of elongated members each having a handle 124 located at a distal end is shown. Each elongated member is rotatably attached to frame 101 at pivot points 126. Links 125 are rotatably connected to a respective elongated member at one end illustrated as point 127 and rotatably connected at or near the other end to respective output links 103 at the first connection point 113.

The motion resulting from rotation of the crank about its axis is that of a teardrop shape at pedal arm pivot point 116 (P1 in FIG. 4 and 5) as opposed to the ellipse shown in U.S. Pat. No. 5,997,445 to Maresh, et al. It is this teardrop shape motion traveled by the pedal arm pivot point of each pedal arm 110 that provides a pedal motion which is more representative of the normal foot motion than the circular or elliptical motions provided in other exercise machines.

Figure 3:
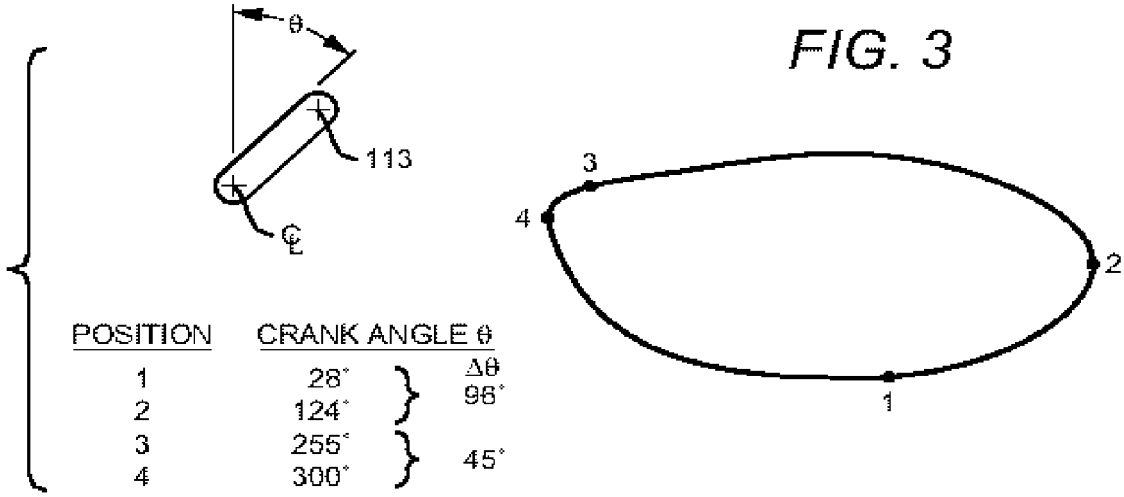
FIG. 3 is a diagram showing the relationship of points on the pedal travel path to crank position during a stride.

FIG. 3 is a graphical representation of one variation of a pedal travel path of pedals 112 in response to the cyclic path traveled by pedal arm pivot point 116. It is to be understood that the pedal travel path can be altered by adjusting the elevation angle of guide 109, or adjusting the pivotal connections to frame 101 of rockers 105 and 106.

When a pedal 112 is traveling rearward, it takes approximately 96 degrees of crank rotation from the time the heel just begins to lift at position 1 until it comes to the maximum rear point at position 2, stops and begins forward motion. On the other hand, it takes just 45 degrees of crankshaft rotation for the heel to just start to lower at the front of the stride at position 3 until the pedal stops traveling forward at position 4 and reverses direction to travel rearward again.

This differential in the motion in the rear portion and front portion of the stride is what makes the motion of the present invention feel more natural to the user. When a person strides, it takes a significant portion of the stride for the person's heel to come up and begin a forward stride to the next footfall. Upon reaching maximum stride length, a person's heel is relatively closer to the ground and hence it takes relatively less time to lower the heel and begin the rearward portion of the stride.

Figure 4:
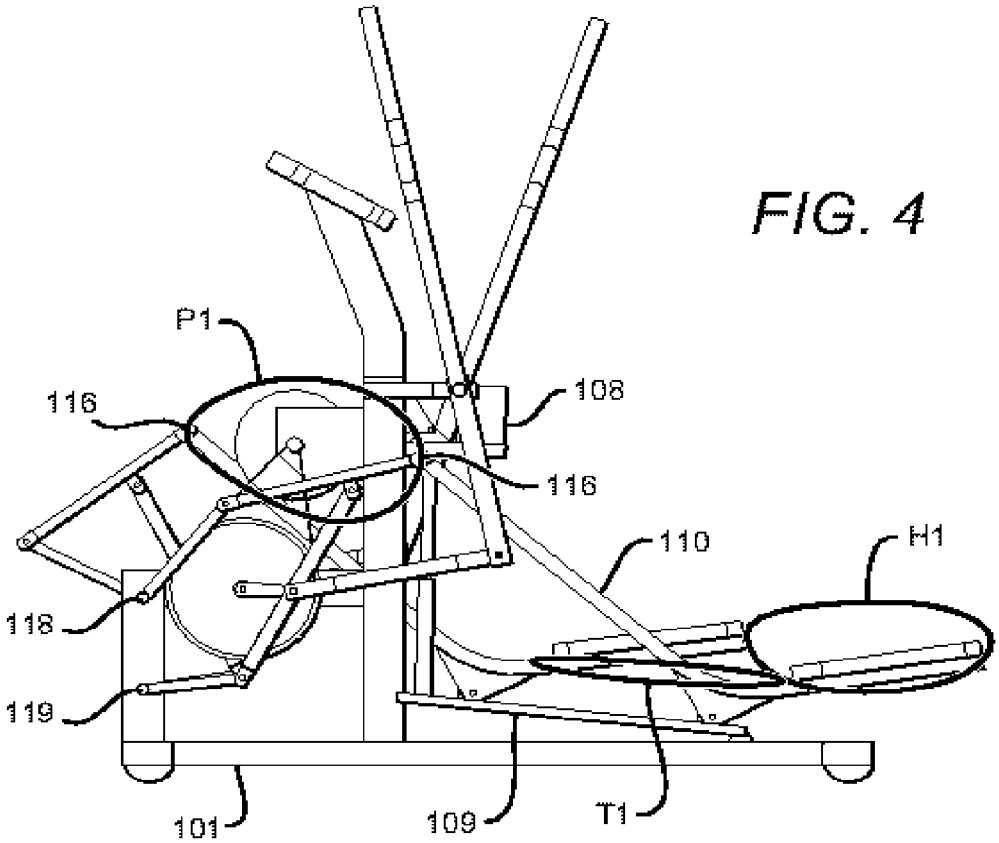
FIG. 4 is a side view of the exercise device shown in FIG. 1 showing the kinematic paths of key points with the guide path at a relatively horizontal position with respect to the floor.
Figure 5:
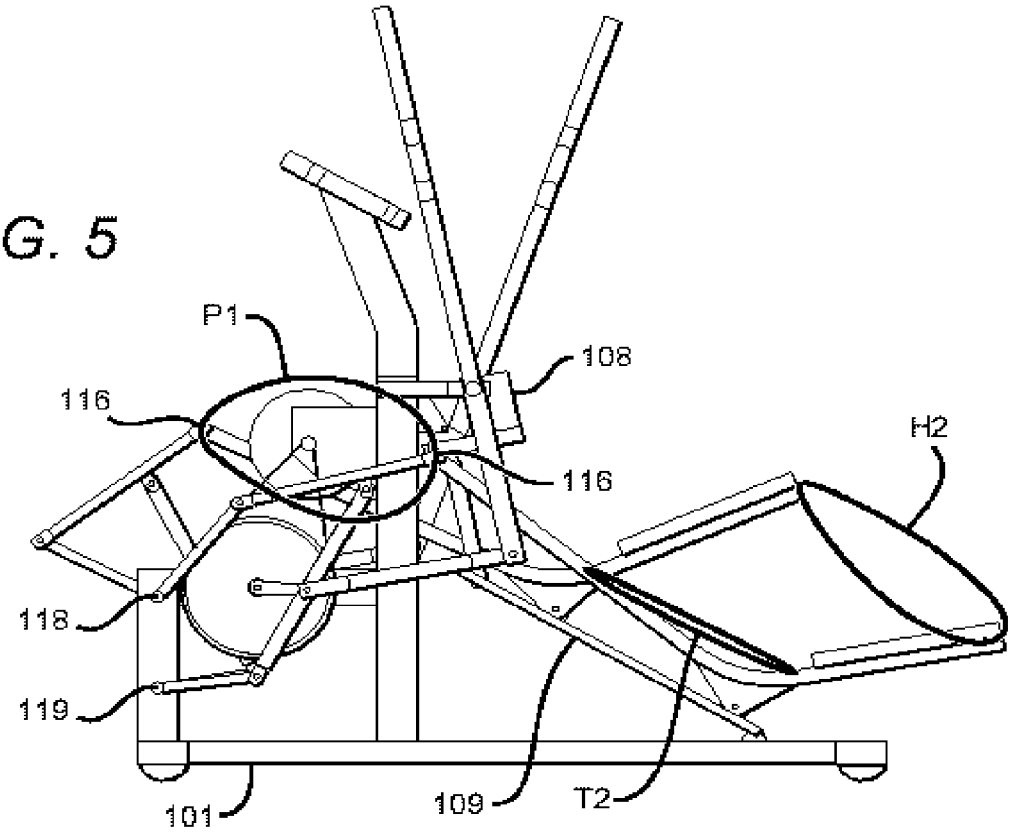
FIG. 5 is a side view of the exercise device shown in FIG. 1 showing the kinematic paths of key points with the guide path at a relatively inclined position with respect to the floor.

Another aspect of the invention is shown in FIG. 4 and FIG. 5. In FIG. 4 the preferred embodiment exercise machine is shown with guide 109 inclined at a relatively horizontal position relative to the ground. This guide path inclination produces paths at the heel and toe H1 and T1, respectively.

In FIG. 5 the same machine has guide 109 inclined at a relatively steep angle to the ground. This produces paths at the heel and toe of H2 and T2, respectively. This change allows an exercise machine constructed under the principles of this invention to focus exercise on different muscle groups of the lower body.

Figure 6:
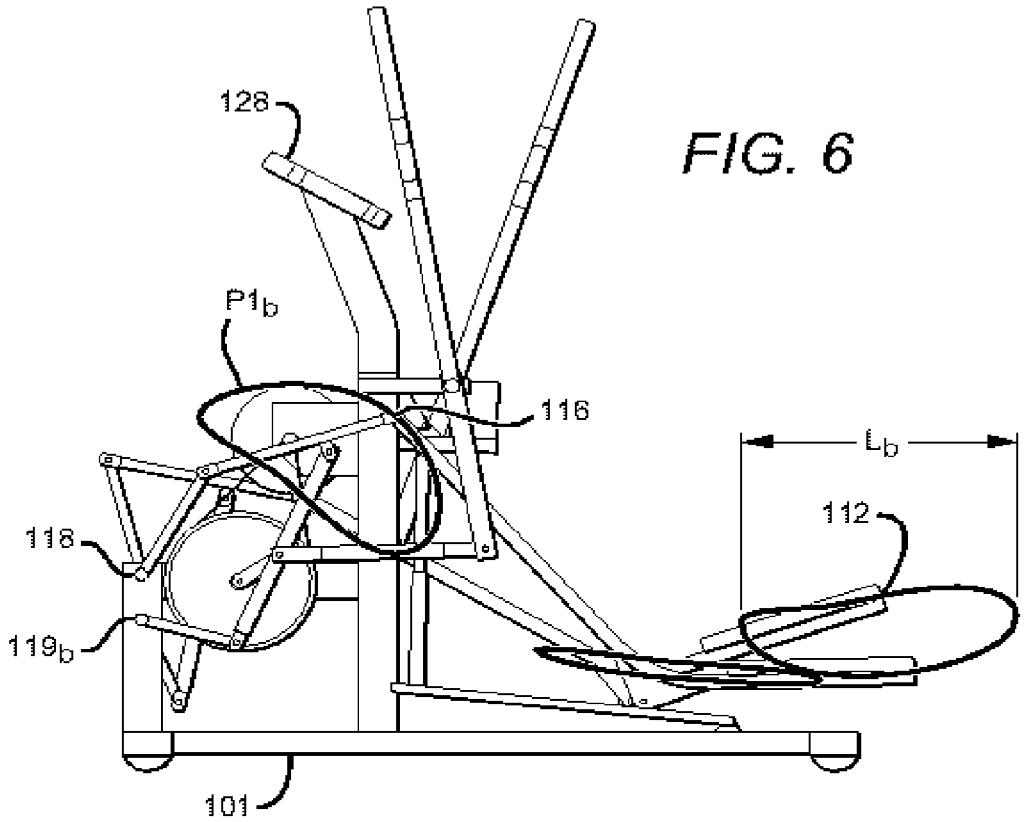
FIG. 6 is a side view of yet another aspect of the exercise device shown in FIG. 1 with the rocker pivot point in one location.
Figure 7:
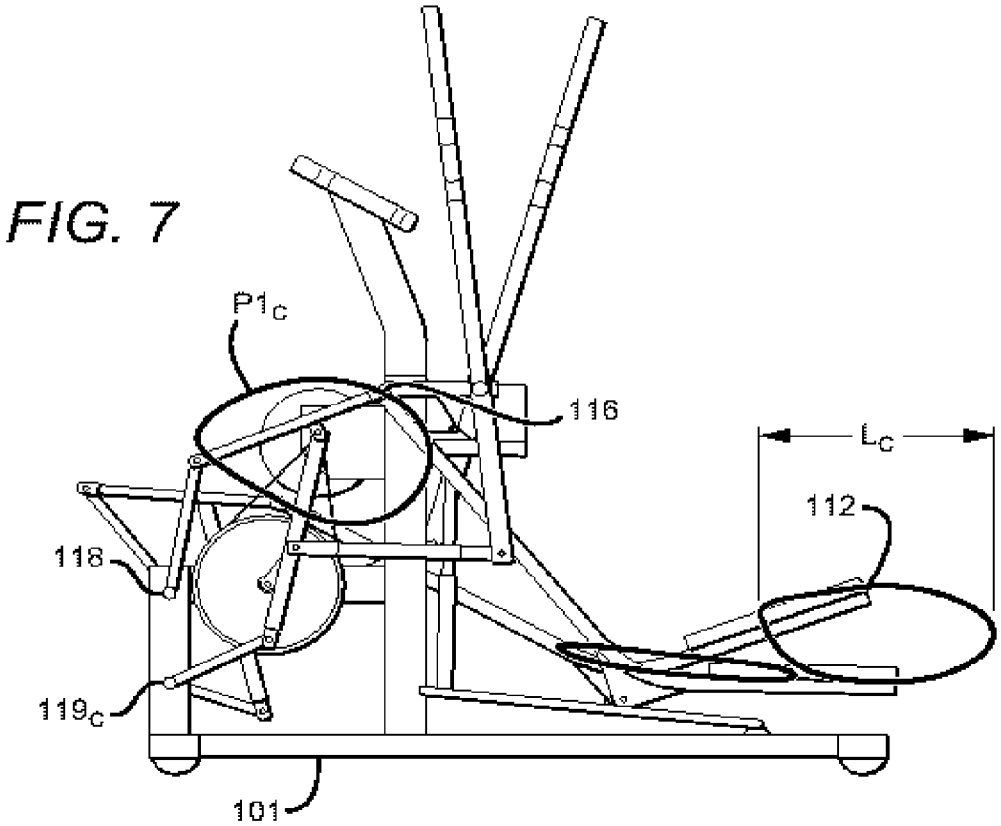
FIG. 7 is a side view of the exercise device shown in FIG. 6 with the rocker pivot in a second location.

FIG. 6 and FIG. 7 illustrate another aspect of the invention. Those skilled in the art will recognize that changes in stride length and shape can be had by changing the position of pivot points 118 and/or 119. This can be done a number of different ways and can be controlled by actuator(s) such that the location of these points is controllable by the user or by automatic control located programmed at the user console 128. FIG. 6 shows pivot point 119*b* at a relatively high location relative to the crank centerline. This produces a path P1*b* traveled by pedal arm pivot point 116 and results in the travel path of pedals 112 being a relatively long, slim stride with length Lb.

In FIG. 7 the location of the pivot 119 has been moved to position 119*c*. The resulting path at pedal arm pivot point 116 is P1*c*, which is much different than P1*b* of FIG. 6. The resulting pedal path traveled by the heel portion of a user's foot as shown in FIG. 7 is shorter with path length Lc and has a larger path height than that shown in FIG. 6.

Moreover, those skilled in the art will recognize that any of the constraints at locations 115 (first pivot point), 117 (second pivot point), or 111 (axle) can include any suitable alternative, be it rolling, sliding, a pivoting rocker, or so on, and the principles of the present invention continue to apply.

Further, those skilled in the art will recognize that further configurations are possible wherein pedals 112 lie medial to respective pivot connections 116 and the constraint represented by wheels 111.

Figure 8:
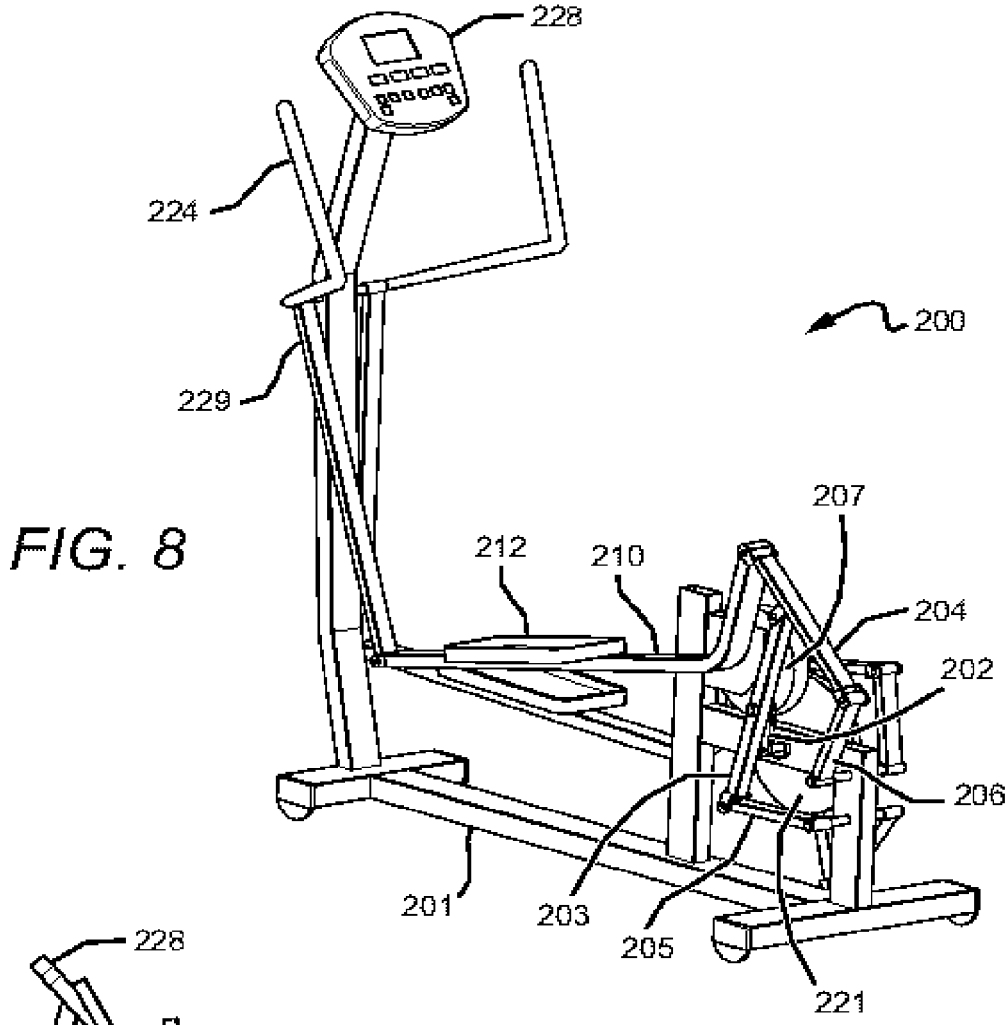
FIG. 8 is a perspective view of a second exercise device constructed in accordance with the present invention.
Figure 9:
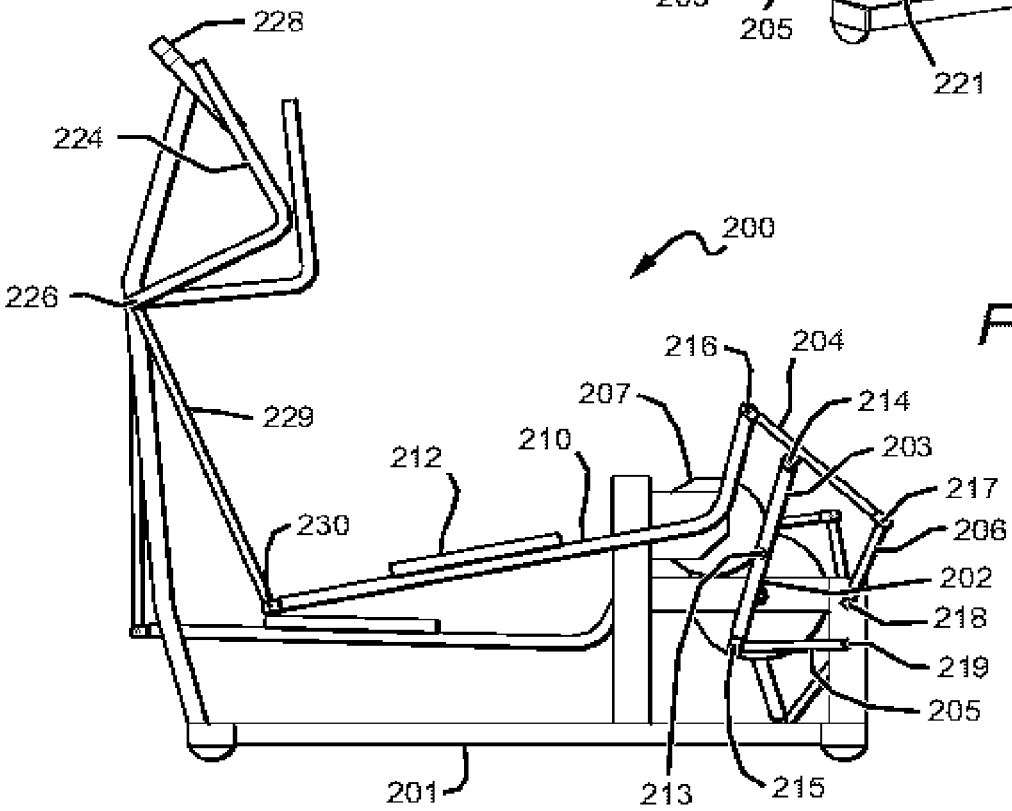
FIG. 9 is a side view of the exercise device shown in FIG. 8.

An alternative embodiment is illustrated by the rear-drive exercise device 200 shown in FIG. 8 and FIG. 9. The exercise machine includes a generally symmetrical layout of left and right hand linkage elements mounted on frame 201. Generally speaking, the motion of the linkage elements link and convert a relatively complex closed path at the left and right pedals 212 to the circular motion traveled by crank arms 202.

The linkage assembly is comprised of left and right pedal arms 210, left and right intermediate links 204, left and right output links 203, rocker links 205 and 206.

Left and right output links 203 are rotatably connected to respective left and right crank arms 202 at respective crank pivots 213, wherein the left and right crank arms are essentially 180 degrees apart from one another and are connected via a common shaft to an output pulley 221. This output pulley is linked via a belt or other suitable means (not shown) to a resistance device 207. The left and right output links 203 are rotatably connected at respective pivot connections 215 to left and right rockers 205. The opposite ends of the left and right rockers 205 are rotatably connected to the front portion of frame 201 at respective pivot arms 219.

The opposite ends of the left and right output links 203 are rotatably connected to respective left and right intermediate links 204 at respective pivot points 214. One end of each left and right intermediate link 204 is rotatably connected to its respective left and right rocker 206 at pivot point 217. The opposite ends of the left and right intermediate rockers 206 are rotatably connected to the front portion of frame 201 at respective pivot points 218. The opposite ends of the intermediate links 204 are rotatably connected to the left and right pedal arms 210 at pivot point 216.

The left and right pedal arms 210 each contain a pedal 212 suitably configured to accept a person's foot and are rotatably connected to support link 229 at pivot point 230. Rocker 229 is rotatably connected to frame 201 at pivot point 226 thereby defining a frame pivot point. A handle 224 may be fitted to the rocker to add a complimentary upper body exercise mode.

A control console 228 is provided as a means of controlling the resistance exerted by resistance device 207.

The invention claimed is:

1. An exercise device comprising:

a frame intended to rest on a floor or other supporting surface, said frame having a crank axis which is essentially perpendicular to the longitudinal axis of said exercise device;

a pair of cranks, each crank rotatably connected to said frame at said crank axis;

a pair of output links each having a pair of distal ends and a medial portion, said output links operably connected to a respective crank, wherein each output link is rotatably connected to its respective crank at its medial portion thereby defining a first connection point, each said output link operatively connected to said frame near one of said distal ends thereby defining a first pivot point, that limits movement in a first reciprocating path relative to said frame;

a pair of intermediate links each having a pair of distal ends and a medial portion, wherein each intermediate link is operatively connected to said frame near one of said distal ends thereby defining a second pivot point that limits movement in a second reciprocating path relative to said frame, and where each said intermediate link is rotatably connected at its medial portion to the second distal end of a respective output link thereby defining a third pivot point; and, a pair of elongated pedal arms, each pedal arm having a surface area for an individual to stand upon with one foot and an axle, each pedal arm operatively connected to a respective intermediate link near the end distal from said second pivot point thereby defining a pedal arm pivot point, said axle operatively engaging said frame thereby limiting movement in a third reciprocating path relative to said frame; and, wherein each of said pedal arm pivot points travel in a substantially tear-drop cyclic path in response to displacement of said pedals arms along said third reciprocating path.

2. The exercise device of claim 1, wherein a respective first rocker link is pivotally interconnected between said frame and a respective said first pivot point.

3. The exercise device of claim 1 further comprising at least one output pulley and at least one resistance device operatively connected to one another by a belt, direct drive or chain, said output pulley connected to said pair of cranks.

4. The exercise device of claim 2, wherein a respective second rocker link is pivotally interconnected between said frame and a respective said second pivot point.

5. The exercise device of claim 1, wherein a respective first rocker link is pivotally interconnected between said frame and said second pivot point.

6. The exercise device of claim 2, wherein the pivotal connection of said first rocker link to the frame is selectively movable.

7. The exercise device of claim 4, wherein the pivotal connection of said second rocker link to the frame is selectively movable.

8. The exercise device of claim 5, wherein said pivotal connection is selectively movable relative to said frame.

9. The exercise device of claim 1 wherein said frame includes a guide.

10. The exercise device of claim 9 wherein said guide has a pivotal first end connected to said frame defining a fourth pivot point and a second distal end, where said guide can be pivoted at the first end to adjust the inclination of said guide relative to the frame.

11. The exercise device of claim 10 wherein an actuator is connected to said frame and further operably connected near the second distal end of said guide.

12. The exercise device of claim 1 wherein a wheel is rotatably connected to said axle for travel along said third reciprocating path.

13. The exercise device of claim 11 wherein each said respective axle has a wheel rotatably connected thereto and each wheel engages said guide for travel along said third reciprocating path.

14. The exercise device of claim 1, wherein each said axle is located between each respective said surface area and pedal arm pivot point.

15. The exercise device of claim 1, wherein each said surface area is located between said respective axle and pedal arm pivot point.

16. The exercise device of claim 1 further comprising a pair of support links, each said support link is pivotally connected to said frame, defining a frame pivot point, and pivotally connected to a respective pedal arm at said axle.

17. The exercise device of claim 16, wherein said frame pivot point is selectively adjustable relative to the frame.

18. The exercise device of claim 16, wherein said support links each include a handle extending generally upward from said pivotal connection.

19. The exercise device of claim 1, wherein said pedal arms are pivotable about the pedal arm pivot point for transportation or storage.

20. The exercise device of claim 9, wherein said guide is pivotable into a generally upward folded position for transportation or storage.

21. The exercise device of claim 1 wherein said substantially tear-drop cyclic path is narrowed and relatively sharp in shape at one end and large and relatively rounded at the other.

22. The exercise device of claim 1 further comprising a pair of elongated members each having a handle located at a distal end, each of said members pivotally connected to said frame at one point and operatively connected to a respective said output link.

23. An exercise device comprising:

a frame intended to rest on a floor or other supporting surface, said frame having a crank axis which is essentially perpendicular to the longitudinal axis of said exercise device;

a pair of cranks, each crank rotatably connected to said frame at said crank axis;

a pair of output links each having a pair of distal ends and a medial portion, said output links operably connected to a respective crank, wherein each output link is rotatably connected to its respective crank at its medial portion thereby defining a first connection point, each said output link operatively connected to said frame near one of said distal ends thereby defining a first pivot point, that limits movement in a first reciprocating path relative to said frame;

a pair of elongated members each having a handle located at a distal end, each of said members pivotally connected to said frame at one point and operatively connected to a respective said output link;

a pair of intermediate links each having a pair of distal ends and a medial portion, wherein each intermediate link is operatively connected to said frame near one of said distal ends thereby defining a second pivot point that limits movement in a second reciprocating path relative to said frame, and where each said intermediate link is rotatably connected at its medial portion to the second distal end of a respective output link thereby defining a third pivot point; and, a pair of elongated pedal arms, each pedal arm having a surface area for an individual to stand upon with one foot, a traveling means for limiting movement of a portion of a respective pedal arm along one direction to a reciprocating movement;

each pedal arm operatively connected to a respective intermediate link near the end distal from said second pivot point thereby defining a pedal arm pivot point, said axle operatively engaging said frame thereby limiting movement in a third reciprocating path relative to said frame; and, wherein each of said pedal arm pivot points travel in a substantially tear-drop cyclic path in response to displacement of said pedals arms along said third reciprocating path.

24. The exercise device of claim 22 wherein said traveling means is either a rocker link, or at least one rotatable wheel connected to the pedal arm by an axle, or a sliding sleeve, where the sleeve or wheel is designed to travel along a guide.

25. The exercise device of claim 1 wherein said substantially tear-drop cyclic path is narrowed and relatively sharp in shape at one end and large and relatively rounded at the other.

26. The exercise device of claim 23 wherein said substantially tear-drop cyclic path is narrowed and relatively sharp in shape at one end and large and relatively rounded at the other.

* * * * *